US010443355B2

(12) United States Patent
Glaser

(10) Patent No.: US 10,443,355 B2
(45) Date of Patent: Oct. 15, 2019

(54) LATERAL DEFLECTOR WITH FEEDTHROUGH FOR CONNECTION TO INTELLIGENT SYSTEMS

(71) Applicant: Halliburton Energy Services, Inc., Houston, TX (US)

(72) Inventor: Mark C. Glaser, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 91 days.

(21) Appl. No.: 15/543,685

(22) PCT Filed: Sep. 28, 2016

(86) PCT No.: PCT/US2016/054078
§ 371 (c)(1),
(2) Date: Jul. 14, 2017

(87) PCT Pub. No.: WO2018/063175
PCT Pub. Date: Apr. 5, 2018

(65) Prior Publication Data

US 2018/0328148 A1 Nov. 15, 2018

(51) Int. Cl.
*E21B 23/00* (2006.01)
*E21B 41/00* (2006.01)
(Continued)

(52) U.S. Cl.
CPC ..... *E21B 41/00* (2013.01); *E21B 7/061* (2013.01); *E21B 17/003* (2013.01);
(Continued)

(58) Field of Classification Search
CPC ..... E21B 7/061; E21B 23/002; E21B 17/028
See application file for complete search history.

(56) References Cited

U.S. PATENT DOCUMENTS 2,674,034 A * 4/1954 Stone ..... E21B 17/12 29/236
7,207,390 B1 4/2007 Pratt
(Continued)

FOREIGN PATENT DOCUMENTS

WO 98/45568 A2 10/1998
WO 2012166396 A1 12/2012
WO 2015167935 A1 11/2015

OTHER PUBLICATIONS

International Search Report and Written Opinion date dated Jun. 26, 2017; International PCT Application No. PCT/US2016/054078.
(Continued)

*Primary Examiner* — Giovanna C Wright
(74) *Attorney, Agent, or Firm* — McGuireWoods LLP

(57) ABSTRACT

Provided are systems for connecting a control line to an intelligent tool positioned below a lateral borehole junction in accordance with the disclosure and the illustrated FIGURES. An example system comprises a lateral deflector. The lateral deflector comprises a lateral deflector body, a lateral deflector top coupled to the lateral deflector body, a deflection surface, and a feedthrough which is covered by the lateral deflector top when the lateral deflector top is coupled to the lateral deflector body. The lateral deflector top is removable and configured to be decoupled from the lateral deflector body. The system further comprises a tubular string, a control line connector head coupled to the tubular string, a first control line coupled to the feedthrough and descending downhole of the lateral borehole junction, and a second control line coupled to the control line connector head and descending downhole from the surface.

18 Claims, 6 Drawing Sheets

(51) Int. Cl.

| | |
|---|---|
| ***E21B 7/06*** | (2006.01) |
| ***E21B 23/12*** | (2006.01) |
| ***E21B 17/02*** | (2006.01) |
| ***E21B 17/00*** | (2006.01) |

(52) U.S. Cl.
CPC ..... *E21B 17/023* (2013.01); *E21B 17/026* (2013.01); *E21B 23/002* (2013.01)

(56) References Cited

U.S. PATENT DOCUMENTS

| | | | | |
|---|---|---|---|---|
| 7,866,414 | B2 | 1/2011 | Patel | |
| 9,249,559 | B2 | 2/2016 | Dyer et al. | |
| 9,291,003 | B2 | 3/2016 | Sponchia et al. | |
| 2002/0074120 | A1* | 6/2002 | Scott | E21B 7/061 166/313 |
| 2004/0149444 | A1 | 8/2004 | Cavender | |
| 2005/0121190 | A1* | 6/2005 | Oberkircher | E21B 41/0035 166/250.1 |
| 2006/0243454 | A1 | 11/2006 | Bolze et al. | |
| 2007/0034384 | A1 | 2/2007 | Pratt | |
| 2008/0047703 | A1* | 2/2008 | Stoesz | E21B 17/028 166/65.1 |
| 2011/0192596 | A1 | 8/2011 | Patel | |
| 2013/0327572 | A1 | 12/2013 | Sponchia et al. | |
| 2015/0233190 | A1 | 8/2015 | Wolf et al. | |

OTHER PUBLICATIONS

Jacob, et al.; "Advanced Well Completion Designs to Meet Unique Reservoir and Production Requirements," 2014, pp. 1-13, Society of Petroleum Engineers, www.onepetro.org, SPE-172215-MS.

Schlumberger, "Prototype Test of an All-Electric intelligent Completion System for Extreme Reservoir Contact (ERC) Wells," 2013, pp. 1-13, Society of Petroleum Engineers, SPE 166507.

* cited by examiner

LATERAL DEFLECTOR WITH FEEDTHROUGH FOR CONNECTION TO INTELLIGENT SYSTEMS

TECHNICAL FIELD

The present disclosure relates to lateral deflectors for drilling lateral boreholes off of a primary borehole, and more particularly, to a lateral deflector which allows access and connection to a control line placed downhole of the lateral borehole junction.

BACKGROUND

The borehole of a well may be oriented in any direction. For example, vertical, horizontal, or deviated boreholes may be used to penetrate a subterranean formation. Moreover, a well may contain multiple branching lateral boreholes off the primary borehole. These types of wells may be referred to as "multilateral wells" and may comprise a primary borehole with at least one lateral borehole which branches off and extends from the primary borehole into the surrounding subterranean formation.

The lateral borehole of the multilateral well may be completed after the main primary borehole. For example, the lateral borehole may be formed by running a drill string into the primary borehole and then extending the drill string through a milled or preformed opening in the casing of the primary borehole where the drill string may then be used to drill into the surrounding formation to form the lateral borehole. The lateral borehole needs to be angled off the primary borehole in order to be drilled through the opening in the casing and in the desired direction and orientation. This angling and orienting of the lateral borehole is performed through the use of a lateral deflector. A "lateral deflector" (e.g., a whipstock) refers to any piece of borehole equipment which comprises a surface used to deflect the drill string such that the deflected drill string may be angled to drill the lateral borehole at the desired orientation. The lateral deflector may be placed at the desired junction point prior to drilling the lateral borehole and anchored in place or run-in on a string, conduit, etc. placed in the primary borehole.

One problem of multilateral wells is that intelligent systems (e.g., intelligent completions systems) requiring surface control or communication may not be used below the junction point of the lateral borehole when the lateral deflector is in place. This occurs because the lateral deflector blocks coupling of control lines downhole of the junction and also because the inner diameter of the primary borehole must remain clear of any equipment while the drill string is used to drill the lateral borehole. Any equipment inside the inner diameter of the primary borehole may be damaged by the drill string during the drilling operation. Another issue is that completion of the lateral borehole requires that the dual tubular string does not damage any equipment as it is run into the primary borehole and down to the junction point. As such, any equipment susceptible to contact damage from the dual tubular string must be shielded from such contact during run-in.

BRIEF DESCRIPTION OF THE DRAWINGS

Illustrative examples of the present disclosure are described in detail below with reference to the attached drawing figures, which are incorporated by reference herein, and wherein.

Figure 1:
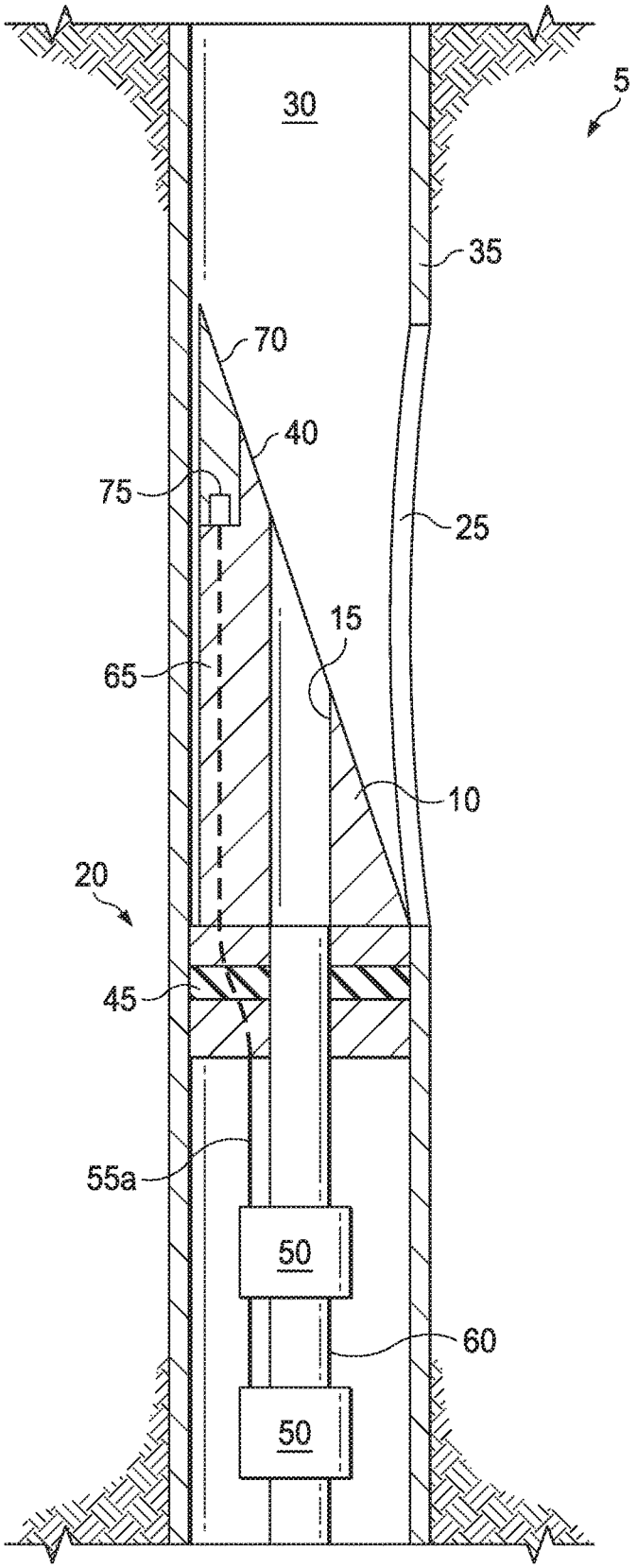
FIG. 1 is a cross-sectional view of system for connecting an intelligent tool or system below a lateral borehole junction.

The illustrated figures are only exemplary and are not intended to assert or imply any limitation with regard to the environment, architecture, design, or process in which different examples may be implemented.

DETAILED DESCRIPTION

The present disclosure relates to lateral deflectors for drilling lateral boreholes off of a primary borehole, and more particularly, to a lateral deflector which allows access and connection to a control line placed downhole of the lateral borehole junction.

Disclosed herein are examples of and methods for using a lateral deflector to drill a lateral borehole off a primary borehole at a lateral borehole junction and to connect a control line extending from the surface to an intelligent system positioned downhole of the lateral borehole junction. The lateral deflector comprises a deflection surface, a feedthrough, a deflector body, and a deflector top. The deflector body and deflector top may be separated from each other as desired. The deflection surface guides the drill string so as to drill the lateral borehole at the desired angle and orientation. The deflector top protects the feedthrough while the lateral borehole is drilled. The deflector top may then be removed by separating it from the deflector body. Separation of the deflector top from the deflector body exposes the feedthrough. The feedthrough, generally, is the control line connector at the potential point of connection between the portion of the control line descending from the surface and the portion of the control line descending below the lateral borehole junction. The feedthrough is itself, or may be adjacent to and connected to, the connecting end of the portion of the control line descending below the lateral borehole junction. The feedthrough does not imply any one type of specific control line connection and may be a connection point for electric control lines, hydraulic control lines, fiber optic control lines, and the like. The feedthrough may be coupled to a control line connected to one or more intelligent systems or tools positioned downhole of the lateral borehole junction point via a portion of control line. A control line connector head coupled to the primary borehole tubular of a tubular string may couple the feedthrough to a control line descending from the surface when the dual tubular string is run in the well. The control line may then be used to operate the intelligent systems positioned downhole of the lateral borehole junction point. Examples of the present disclosure and its advantages may be understood by referring to FIGS. 1 through 9B, where like numbers are used to indicate like and corresponding parts.

The terms uphole and downhole may be used to refer to the location of various components relative to the bottom or end of a well. For example, a first component described as uphole from a second component may be further away from the end of well than the second component. Similarly, a first component described as being downhole from a second component may be located closer to the end of well than the second component.

FIG. 1 is a cross-sectional view of system, generally 5, for connecting an intelligent tool or system below a lateral borehole junction. The system 5 comprises lateral deflector 10 illustrated with a thru bore 15. Lateral deflector 10 may be any type of lateral deflector for deflecting a drill string. Examples of lateral deflector 10 include any piece of borehole equipment which comprises a surface used to deflect the drill string such that the deflected drill string may be angled to drill a lateral borehole from within a primary borehole as desired. Specific examples of lateral deflector 10 include a whipstock.

In some examples, lateral deflector 10 may be hollow and comprise a thru bore 15 as illustrated in FIG. 1. Although the lateral deflector 10 is depicted as comprising a thru bore 15, it is to be understood that a thru bore 15 may be added to lateral deflector 10 as desired, and that the lateral deflector 10 may be manufactured to not comprise a thru bore 15 in some examples. As such, a thru bore 15 may be milled or otherwise added to lateral deflector 10 when desired, or lateral deflector 10 may be manufactured to comprise a thru bore 15. In some alternative examples (not shown), the lateral deflector 10 may not utilize a thru bore 15, and the wellbore flow may flow around the lateral deflector 10. In FIG. 1, the lateral deflector 5 is positioned at the lateral borehole junction, generally 20, adjacent to the casing window 25. The lateral borehole junction 20 is the junction point where the lateral borehole will be drilled from the primary borehole 30. The casing window 25 is a milled, pre-milled, or otherwise destructible portion of the casing 35 through which the lateral borehole will be drilled. Although a cased primary borehole 30 is depicted, it is to be understood that in some alternative examples the entirety of or at least a portion of primary borehole 30 may be uncased. Lateral deflector 10 comprises deflection surface 40 which may be used to deflect a drill string (not illustrated) to the casing window 25 to drill a lateral borehole with the desired orientation and position.

FIG. 1 illustrates the lateral deflector 10 coupled to an optional packer assembly 45 positioned downhole of the lateral borehole junction 20. Lateral deflector 10 may be run-in the primary borehole 30 with a packer assembly 45, or lateral deflector 10 may be coupled (e.g., punched-in) to a packer assembly 45 which has already been placed in the primary borehole 30. Alternatively, no packer assembly 45 may be used, and wellbore flow may proceed around lateral deflector 10.

With continued reference to FIG. 1, two intelligent tools 50 are positioned downhole of the lateral borehole junction 20. "Intelligent tools," as described herein, refers to tools, sensors, apparatuses, or systems which may be controlled, actuated, or otherwise interacted in any manner from the surface via any type of control line descending from the surface, including obtaining measurement data from sensors or interacting with sensors to obtain measurement data or alter the parameters regarding the obtainment of measurement data. "Control line" does not imply that the line must control the intelligent tool. A control line may be used to transfer data from an intelligent tool to the surface or vice versa. Examples of intelligent tools 50 may include, but are not limited to, inflow control devices, sensors, valves, artificial lifts, interval control devices, pumps, the like, or combinations thereof. Intelligent tools 50 may be coupled to control line 55*a*. Control line 55*a* may be any type of control line used to interact with an intelligent tool 50. Examples of control line 55*a* may include electric lines, hydraulic lines, fiber optic lines, the like, or combinations thereof. In some examples, control line 55*a* may comprise a plurality of control lines of the same or different types. In the illustration of FIG. 1, the intelligent tools 50 may be coupled to conduit 60. Conduit 60 may be any conduit sufficient for use in the primary borehole 30 including any type of tubing, piping, and the like. In some examples, conduit 60 may be part of a completion.

Lateral deflector 10 further comprises a lateral deflector body 65 and lateral deflector top 70. Lateral deflector top 70 may be separated from lateral deflector body 65 and removed from lateral deflector 10. Lateral deflector top 70 may protect the feedthrough 75 during run-in of the lateral deflector 10 and during the lateral borehole drilling operation.

Figure 2:
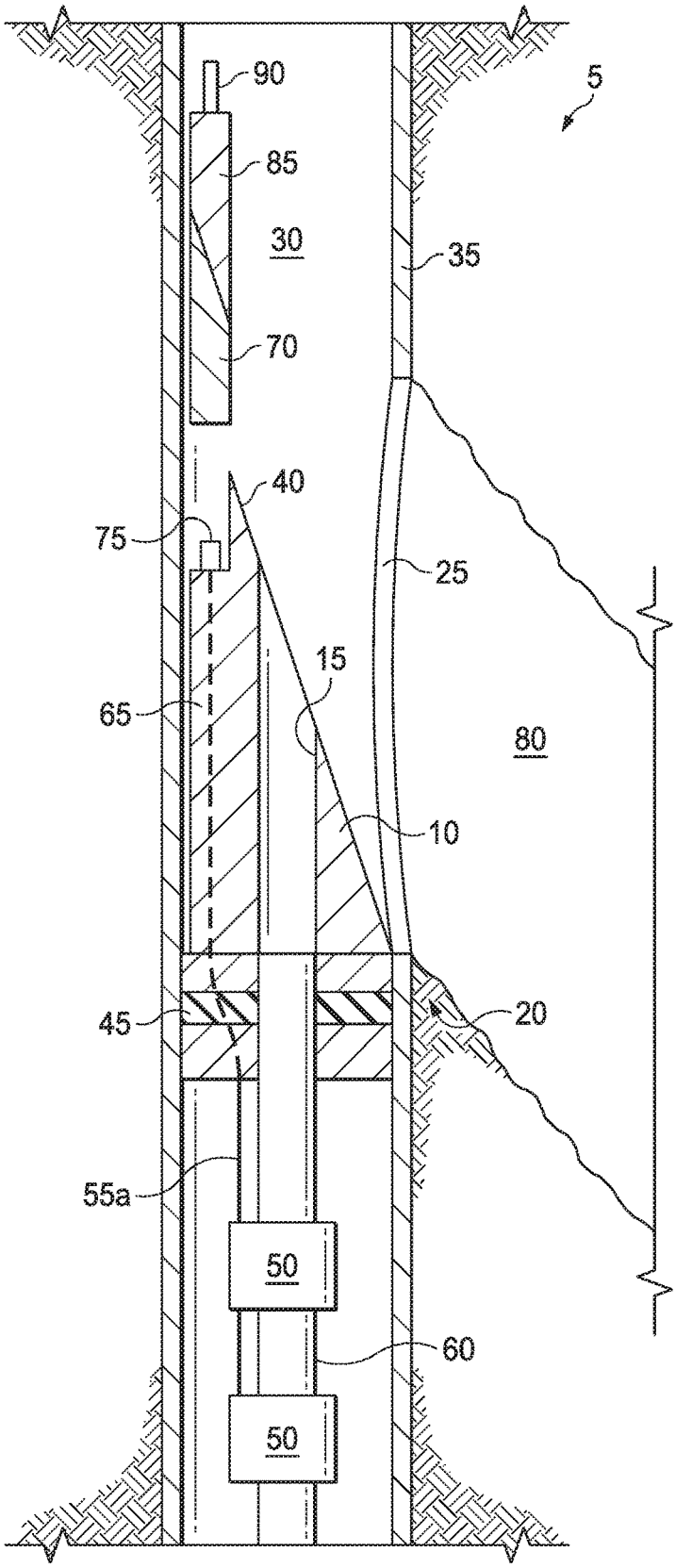
FIG. 2 illustrates a cross-sectional view of system for connecting an intelligent tool or system below a lateral borehole junction and illustrates the lateral deflector of the system with the lateral deflector top removed.

FIG. 2 illustrates a cross-sectional view of system, generally 5, for connecting an intelligent tool 50 or system below a lateral borehole junction 20. FIG. 2 illustrates the lateral deflector 10 of system 5 with the lateral deflector top 70 removed. After a lateral borehole 80 has been drilled off the primary borehole 30, the lateral deflector top 70 may be removed from the lateral deflector body 65. A retrieval tool 85 attached to a wireline 90 or other such retrieval line may be used to connect to the lateral deflector top 70 and to release and retrieve the lateral deflector top 70 from lateral deflector body 65.

Lateral deflector top 70 may be coupled to lateral deflector body 65 with any type of resistance device designed or otherwise intended to give when sufficient force is applied such that the lateral deflector top 70 may remain firmly attached to the lateral deflector body 65 during run-in and during the lateral borehole drilling operation. Lateral deflector top 70 may then be detached from the lateral deflector body 65 if a sufficient amount of force is applied to pull or otherwise release and decouple lateral deflector top 70 from lateral deflector body 65. Examples of such resistance devices used to couple lateral deflector top 70 to lateral deflector body 65 may include, but are not limited to, shear screws, snap rings, collets, the like, or combinations thereof.

The retrieval tool 85 may be used to grasp and retrieve lateral deflector top 70. The retrieval tool 85 may be lowered downhole from the surface via a wireline 90 or any other type of retrieval line for downhole tools. The retrieval tool 85 may comprise a hook or any other such attachment mechanism which may attach the retrieval tool 85 to a corresponding loop, latch, or other such graspable component on the lateral deflector top 70. The attachment mechanism should hold the retrieval tool 85 firmly to the lateral deflector top 70 when attached such that the retrieval tool 85 does not prematurely release lateral deflector top 70. Once attached to the lateral deflector top 70, retrieval tool 85 may then be used to apply force from the surface via wireline 90 to the lateral deflector top 70 to cause the resistance device which couples lateral deflector top 70 to lateral deflector body 65 to give which may result in the release of lateral deflector top 70 from lateral deflector body 65. Lateral deflector top 70 may then be pulled uphole to the surface. Lateral deflector top 70 may be reused as desired. With the lateral deflector top 70 removed from the lateral deflector body 65, the feedthrough 75 may be exposed and used to connect a control line from the surface (not illustrated) to a control line 55*a* coupled to an intelligent tool 50 downhole of the lateral deflector 10.

As illustrated in FIG. 2, feedthrough 75 is coupled to a portion of control line 55*a* which descends downhole below the lateral deflector 10 and connects to the intelligent tools 50 downhole of the lateral borehole junction 20. This portion of the control line 55*a* may be coupled to the feedthrough 75 in any desirable manner. Control line 55*a* may be run through a void in the lateral deflector 10 as illustrated, or alternatively, control line 55*a* may be positioned within a groove milled into the exterior of lateral deflector 10.

Figure 3:
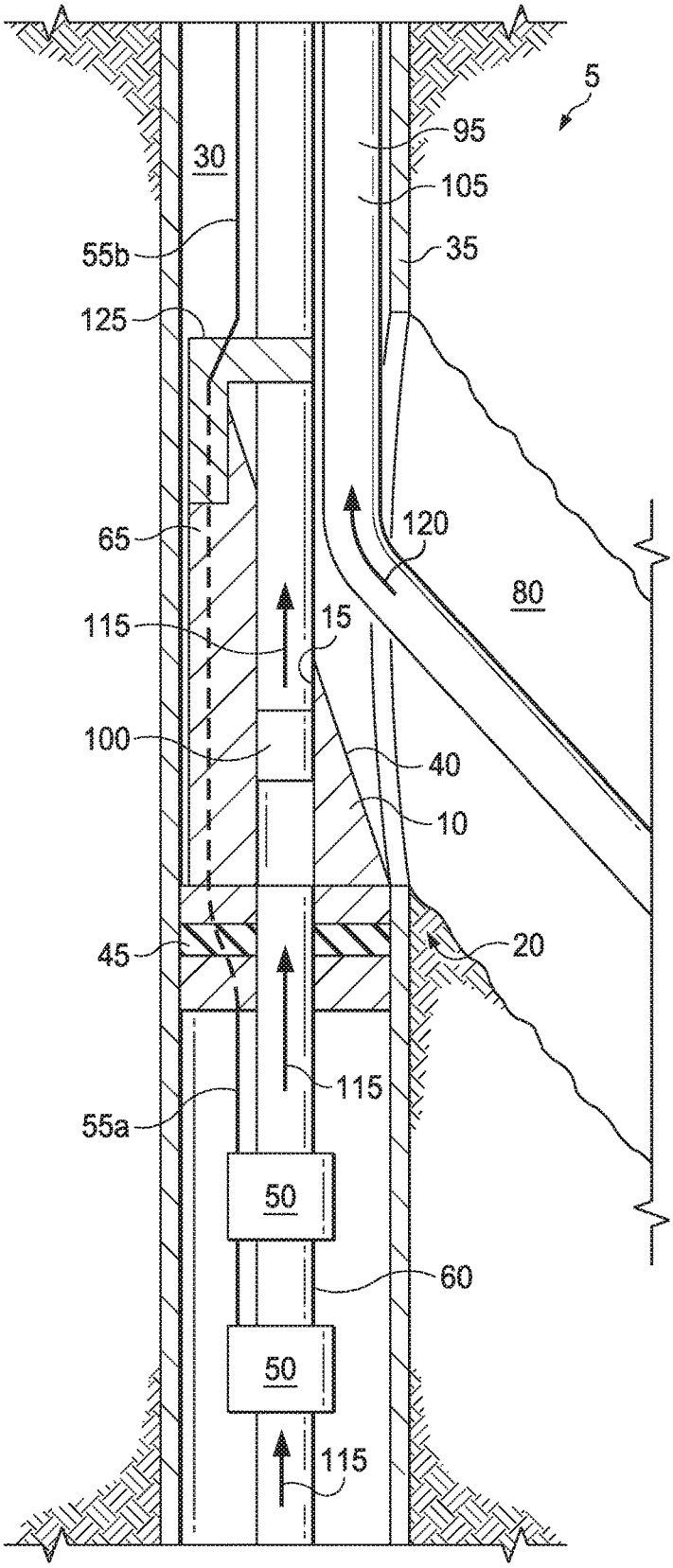
FIG. 3 illustrates a cross-sectional view of system for connecting an intelligent tool or system below a lateral borehole junction and illustrates a portion of a control line descending from the surface coupling to a portion of a control line connected to an intelligent tool downhole of the lateral borehole junction.

FIG. 3 illustrates a cross-sectional view of system, generally 5, for connecting an intelligent tool 50 or system below a lateral borehole junction 20. FIG. 3 illustrates a portion of control line 55*b* descending from the surface coupling to a portion of control line 55*a* which is connected to the intelligent tools 50 downhole of the lateral borehole junction 20. As illustrated in FIG. 2, after the lateral deflector top 70 has been removed, the feedthrough 75 may be exposed. With reference to FIG. 3, a dual tubular string 95 comprising primary string 100 and lateral string 105 may be lowered into primary borehole 30. Primary string 100 comprises a seal assembly 110 which couples to and forms a seal with conduit 60. When primary string 100 is coupled to conduit 60, a flow path traversing lateral deflector 10 is created and fluid flow may proceed to the surface as indicated by arrows 115 via conduit 60 and primary string 100. Lateral string 105 may descend into the lateral borehole producing a flow path for fluid flow to the surface via arrows 120.

With continued reference to FIG. 3, the control line connector head 125 is attached to the primary string 100. The control line connector head 125 is additionally attached to the portion of the control line 55*b* which descends from the surface. The control line connector head 125 connects the control line 55*b* that descends from the surface with the portion of the control line 55*a* coupled to the feedthrough 75 and which descends downhole of the lateral borehole junction 20 to the intelligent tools 50. When the control line connector head 125 couples to the feedthrough 75, the portion of the control line 55*b* descending from the surface is connected to the portion of the control line 55*a*, and the intelligent tools 50 below the lateral borehole junction 20 may be controlled or otherwise interacted with from the surface via the connected portions of control line 55*a* and 55*b*.

The control line connector head 125 and the feedthrough 75 may comprise any type of control line connection. For example, the control line connector head 125 and the feedthrough 75 may comprise wet connects, inductive coupling, or the like. Wet connects refers to connections suitable for wet or otherwise hostile environments, and it is to be understood that the use of "wet connects" is not limited to any one type of wet connector or any one type of specific control line. The wet connects may be used with electric control lines, hydraulic control lines, fiber optic control lines, or the like. Inductive coupling connections may be used for electric control lines and may include the feedthrough 75 and the control line connector head 125, each comprising at least one inductor. Electric current may be run through the inductor of the control line connector head 125 to generate an electrical field sufficient for creating an electric current in the inductor of the feedthrough 75 which may then be used to power one or more intelligent tools 50 downhole of the feedthrough 75.

Figure 4:
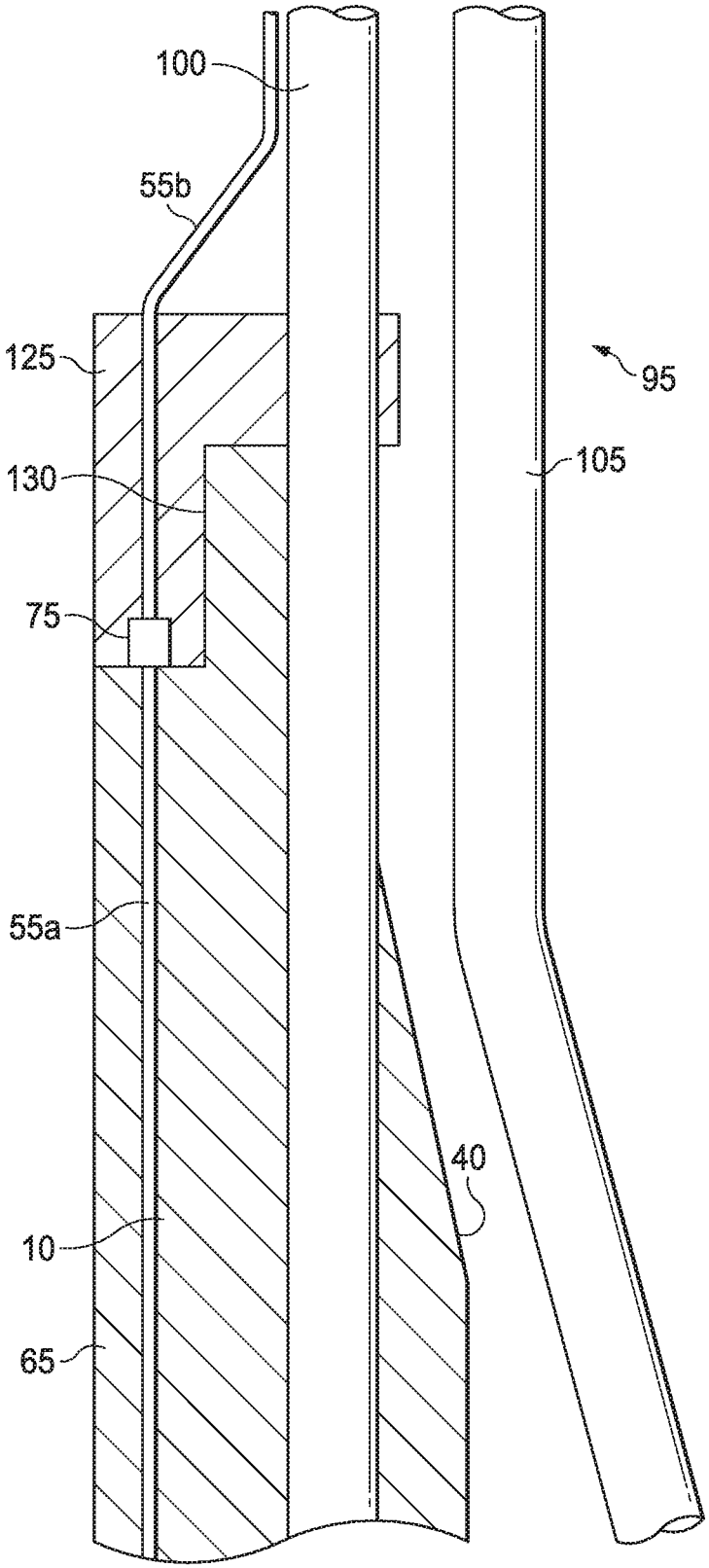
FIG. 4 illustrates an enlarged and simplified cross-sectional view of the control line connector head connected to the feedthrough.

FIG. 4 illustrates an enlarged and simplified cross-sectional view of the control line connector head 125 connected to the feedthrough 75 with some of the components removed for ease of illustration. In the illustrated example, the control line connector head 125 is attached to the primary string 100 of a dual tubular string 95. Dual tubular string 95 is illustrated as additionally comprising lateral string 105 which may descend into a lateral borehole (e.g., lateral borehole 80 as illustrated in FIG. 2). It is to be understood, however, that in some examples a dual tubular string 95 may not be used, and a tubular string comprising only the primary string 100 may be used for connection to a conduit 60 downhole of the lateral borehole junction 20, as illustrated in FIG. 3. In said optional example, a tubular string may not descend into the lateral borehole (e.g., lateral borehole 80 as illustrated in FIG. 3). Control line connector head 125 may be coupled to the primary string 100 in any sufficient manner. For example, control line connector head 125 may be clamped to, threaded to, or glued to the primary string 100. The control line connector head 125 may be any shape sufficient for coupling to the feedthrough 75 and for connecting control line 55*a* to control line 55*b* to form a connected control line. Control line 55*b* may be run through a void in the control line connector head 125 as illustrated, or alternatively, control line 55*b* may be positioned within a groove milled into the exterior of control line connector head 125. The portion of control line 55*b* uphole of the control line connector head 125 may be attached or otherwise affixed to the exterior of the primary string 100 as illustrated. Control line connector head 125 may be shaped such as to traverse and go over and around bevel 130 of lateral deflector body 65. In alternative examples, bevel 130 is optional, and the control line connector head 125 may be shaped to simply couple to the feedthrough 75. Bevel 130 may shaped and sized such that the primary string 100 is not permitted to contact the feedthrough 75 or the area surrounding the feedthrough 75 as explained below.

Figure 5:
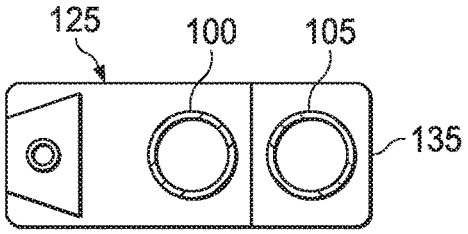
FIG. 5 illustrates a top-down cross-section of an alternative example of the control line connector head connected to a primary string and a lateral string.

FIG. 5 illustrates a top-down cross-section of an alternative example of the control line connector head 125 connected to a primary string 100 and a lateral string 105. In this alternative example, the control line connector head 125 additionally comprises an extension 135, which may or may not be a continuous piece with the control line connector head 125. Extension 135 may be used to couple the control line connector head 125 to the lateral string 105 of a dual tubular string 95.

Figure 6:
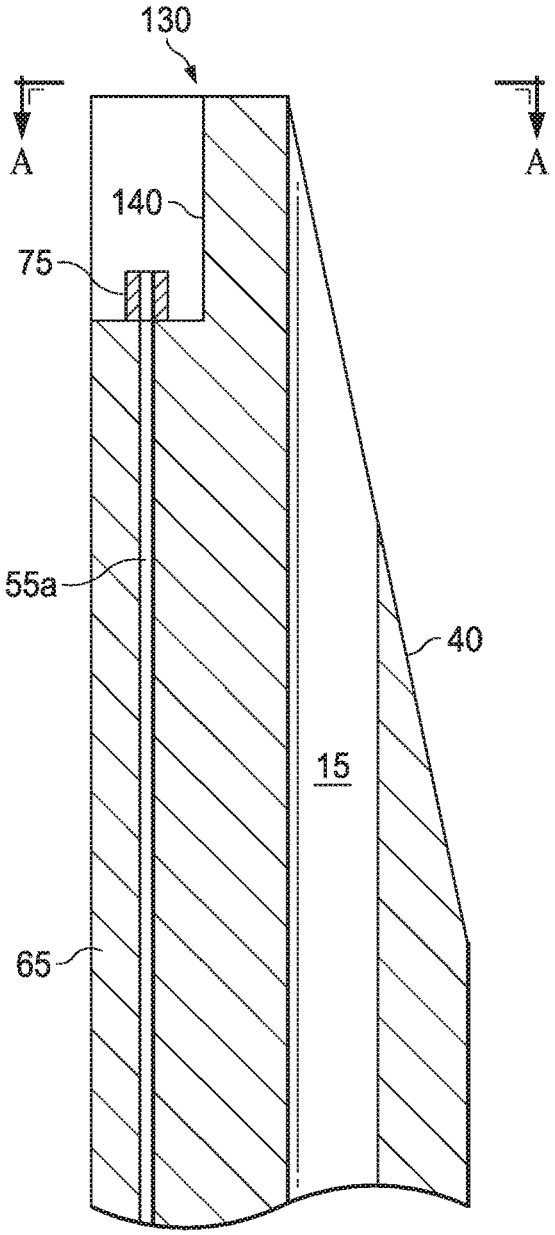
FIG. 6 illustrates an enlarged and simplified cross-sectional view of the lateral deflector body.

FIG. 6 illustrates an enlarged and simplified cross-sectional view of the lateral deflector body 65 with some of the components removed for ease of illustration. In the illustrated example, the deflection surface 40 comprises a concave face through which a thru bore 15 is inserted. The feedthrough 75 is exposed as the lateral deflector top 70 (e.g., as illustrated in FIG. 2) has been previously removed.

The shape of the exterior sides 140 of the lateral deflector body 65 adjacent to the cavity 145 in which the control line connector head 125 is to be inserted may be changed to allow for a specific alignment orientation of the connecting portions of the control line 55*a* and the control line 55*b* at the feedthrough 75. As such, the connecting portions of the control line 55*a* and the control line 55*b* are aligned and connected at the feedthrough 75.

Bevel 130 may be shaped and sized to restrict a tubular (e.g., the primary string 100 or the lateral string 105 as illustrated in FIG. 3) from entering cavity 145 and contacting the feedthrough 75.

Figure 7:
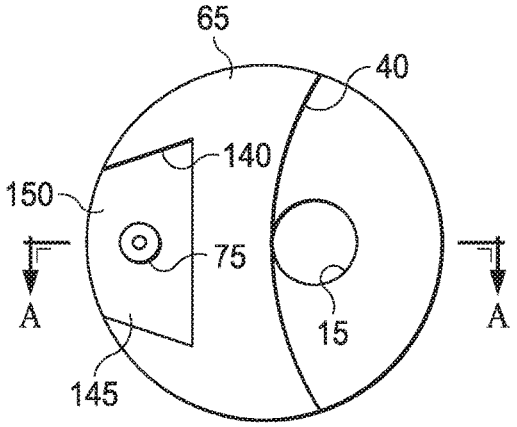
FIG. 7 is one example of a top-down cross-section taken along line A-A of FIG. 6 illustrating an example alignment orientation for the feedthrough.

FIG. 7 is one example of a top-down cross-section taken along line A-A of FIG. 6 illustrating an example alignment orientation for the feedthrough 75. As illustrated, the shape of the exterior sides 140 of the lateral deflector body 65 adjacent to the cavity 145 are shaped in a specific dovetail formation to form a dovetail-shaped cavity 145. A corresponding dovetail shape on the control line connector head 125 allows for the control line connector head 125 to enter the dovetail-shaped cavity 145 and align the connecting points of control line 55*a* and control line 55*b* at the feedthrough 75.

A cutout 150 may be made in one of the exterior sides 140 of the lateral deflector body 65 adjacent to cavity 145 such that any debris which may enter cavity 145 may be pushed out of the cutout 150.

Figure 8:
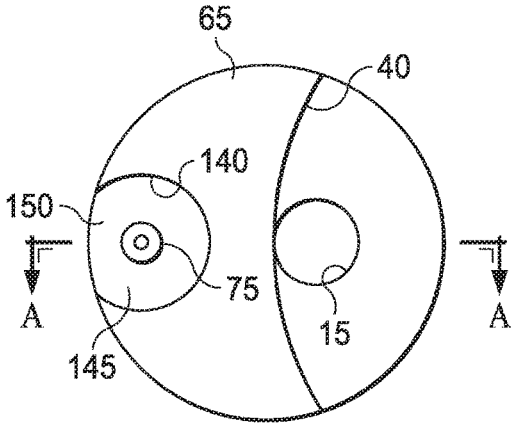
FIG. 8 is another example of a top-down cross-section taken along line A-A of FIG. 6 illustrating an example alignment orientation for the feedthrough.

FIG. 8 is another example of a top-down cross-section taken along line A-A of FIG. 6 illustrating an example alignment orientation for the feedthrough 75. As illustrated, the shape of the exterior sides 140 of the lateral deflector body 65 adjacent to cavity 145 are shaped in a specific circular formation to form a circular-shaped cavity 145. A corresponding circular shape on the control line connector head 125 allows for the control line connector head 125 to enter the circular-shaped cavity 145 and align the connecting points of control line 55*a* and control line 55*b* at the feedthrough 75.

A cutout 150 may be made in one of the exterior sides 140 of the lateral deflector body 65 adjacent to cavity 145 such that any debris which may enter cavity 145 may be pushed out of the cutout 150.

Figure 9A:
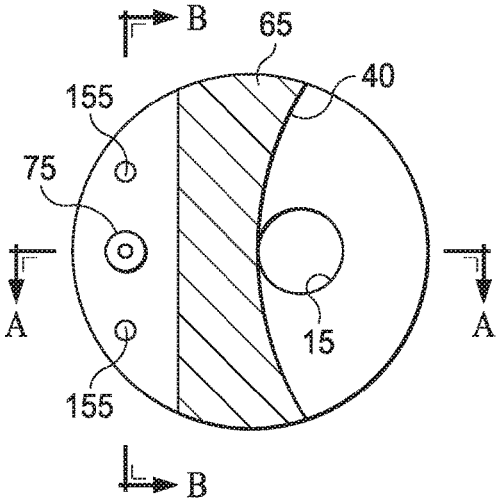
FIG. 9A is another example of a top-down cross-section taken along line A-A of FIG. 6 illustrating an example alignment orientation for the feedthrough.

FIG. 9A is another example of a top-down cross-section taken along line A-A of FIG. 6 illustrating an example alignment orientation for the feedthrough 75. In this example, alignment studs 155 are positioned adjacent to feedthrough 75. The alignment studs 155 may be used to align the connecting points of control line 55*a* and control line 55*b* at the feedthrough 75.

Figure 9B:
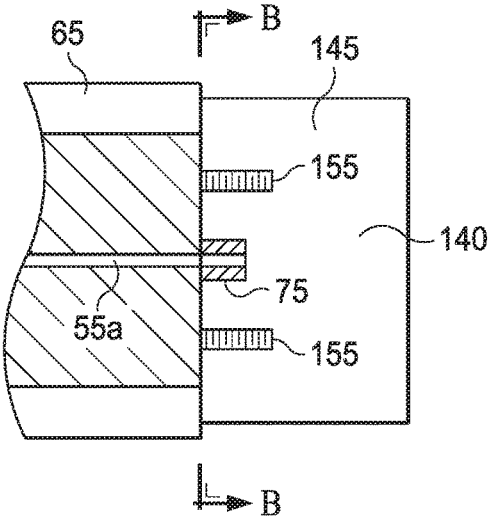
FIG. 9B is a side perspective cross-section taken along line B-B of FIG. 9A illustrating an example alignment orientation for the feedthrough.

FIG. 9B is a side perspective cross-section taken along line B-B of FIG. 9A illustrating an example alignment orientation for the feedthrough 75. In this example, alignment studs 155 are illustrated as extending upwards to allow for corresponding slots in the control line connector head 125 to contact and align the alignment studs 155 such that the connecting points of control line 55*a* and control line 55*b* are aligned at the feedthrough 75.

Provided are systems for connecting a control line to an intelligent tool positioned below a lateral borehole junction in accordance with the disclosure and the illustrated FIGURES. An example system comprises a lateral deflector, the lateral deflector comprising a lateral deflector body: a lateral deflector top coupled to the lateral deflector body; and wherein the lateral deflector top is removable and configured to be decoupled from the lateral deflector body; a deflection surface; a feedthrough which is covered by the lateral deflector top when the lateral deflector top is coupled to the lateral deflector body; a tubular string; a control line connector head coupled to the tubular string; a first control line coupled to the feedthrough and descending downhole of the lateral borehole junction; a second control line coupled to the control line connector head and descending downhole from the surface; an intelligent tool coupled to the first control line and positioned downhole of the lateral borehole junction. The lateral deflector top may be coupled to the lateral deflector body with a shear screw, snap ring, collet, or a combination thereof. A thru bore may be present in the deflection surface and the tubular string may extend through the thru bore. The intelligent tool may be an inflow control device, sensor, valve, artificial lift, interval control device, pump, or combination thereof. The feedthrough may be adjacent to exterior sides of the lateral deflector body and the exterior sides may form a dovetail-shaped cavity and the control line connector head may comprise a dovetail shape sufficient to enter said dovetail-shaped cavity. The feedthrough may be adjacent to exterior sides of the lateral deflector body and the exterior sides may form a circular-shaped cavity and the control line connector head may comprise a circular shape sufficient to enter said circular-shaped cavity. The feedthrough may be adjacent to alignment studs. The first control line and the second control line may comprise a wet connect or an inductor. The first control line and the second control line may comprise an electric line, a hydraulic line, or a fiber optic line.

Provided are lateral deflectors in accordance with the disclosure and the illustrated FIGURES. An example lateral deflector comprises a lateral deflector body; a lateral deflector top coupled to the lateral deflector body; and wherein the lateral deflector top is removable and configured to be decoupled from the lateral deflector body; a deflection surface; a feedthrough which is covered by the lateral deflector top when the lateral deflector top is coupled to the lateral deflector body. The lateral deflector top may be coupled to the lateral deflector body with a shear screw, snap ring, collet, or a combination thereof. The lateral deflector may further comprise a thru bore in the deflection surface. The lateral deflector may be positioned at a lateral borehole junction. A control line may be coupled to the feedthrough and the control line may descend downhole of the lateral borehole junction. The control line may be coupled to an inflow control device, sensor, valve, artificial lift, interval control device, pump, or combinations thereof positioned downhole of the lateral borehole junction. The feedthrough may be adjacent to exterior sides of the lateral deflector body and said exterior sides may form a dovetail-shaped cavity. The feedthrough may be adjacent to exterior sides of the lateral deflector body and said exterior sides may form a circular-shaped cavity. The feedthrough may be adjacent to alignment studs. The first control line and the second control line may comprise a wet connect or an inductor.

Provided are methods for connecting a control line to an intelligent tool positioned below a lateral borehole junction in accordance with the disclosure and the illustrated FIGURES. An example method comprises providing a lateral deflector comprising a lateral deflector body; a lateral deflector top coupled to the lateral deflector body; and wherein the lateral deflector top is removable and configured to be decoupled from the lateral deflector body; a deflection surface; a feedthrough which is covered by the lateral deflector top when the lateral deflector top is coupled to the lateral deflector body; and wherein the feedthrough is coupled to a first control line which extends downhole of the lateral borehole junction and is coupled to an intelligent tool positioned downhole of the lateral borehole junction; decoupling the lateral deflector top from the lateral deflector body; removing the lateral deflector top from the lateral deflector body; coupling a control line connector head to the feedthrough, wherein the control line connector head is coupled to a second control line which descends from the surface; coupling the first and second control lines at the feedthrough to provide a connected control line; and using the control line to interact with the intelligent tool. The lateral deflector top may be coupled to the lateral deflector body with a shear screw, snap ring, collet, or a combination thereof. A thru bore may be present in the deflection surface and the tubular string may extend through the thru bore. The intelligent tool may be an inflow control device, sensor, valve, artificial lift, interval control device, pump, or combination thereof. The feedthrough may be adjacent to exterior sides of the lateral deflector body and the exterior sides may form a dovetail-shaped cavity and the control line connector head may comprise a dovetail shape sufficient to enter said dovetail-shaped cavity. The feedthrough may be adjacent to exterior sides of the lateral deflector body and the exterior sides may form a circular-shaped cavity and the control line connector head may comprise a circular shape sufficient to enter said circular-shaped cavity. The feedthrough may be adjacent to alignment studs. The first control line and the second control line may comprise a wet connect or an inductor. The first control line and the second control line may comprise an electric line, a hydraulic line, or a fiber optic line.

Therefore, the disclosed systems and methods are well adapted to attain the ends and advantages mentioned, as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative embodiments disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A system for connecting a control line to an intelligent tool positioned below a lateral borehole junction, the system comprising:

a lateral deflector comprising:

a lateral deflector body;

a lateral deflector top coupled to the lateral deflector body; and wherein the lateral deflector top is removable and configured to be decoupled from the lateral deflector body;

a deflection surface;

a feedthrough which is covered by the lateral deflector top when the lateral deflector top is coupled to the lateral deflector body;

a tubular string;

a control line connector head coupled to the tubular string;

a first control line coupled to the feedthrough and descending downhole of the lateral borehole junction;

a second control line coupled to the control line connector head and descending downhole from the surface;

an intelligent tool coupled to the first control line and positioned downhole of the lateral borehole junction.

2. The system of claim 1, wherein the lateral deflector top is coupled to the lateral deflector body with a shear screw, snap ring, collet, or a combination thereof.

3. The system of claim 1, further comprising a thru bore in the deflection surface and wherein the tubular string extends through the thru bore.

4. The system of claim 1, wherein the intelligent tool is an inflow control device, sensor, valve, artificial lift, interval control device, pump, or combination thereof.

5. The system of claim 1, wherein the feedthrough is adjacent to exterior sides of the lateral deflector body and said exterior sides form a dovetail-shaped cavity and wherein the control line connector head comprises a dovetail shape sufficient to enter said dovetail-shaped cavity.

6. The system of claim 1, wherein the feedthrough is adjacent to exterior sides of the lateral deflector body and wherein said exterior sides form a circular-shaped cavity and wherein the control line connector head comprises a circular shape sufficient to enter said circular-shaped cavity.

7. The system of claim 1, wherein the feedthrough is adjacent to alignment studs.

8. The system of claim 1, wherein the first control line and the second control line comprise a wet connect or an inductor.

9. The system of claim 1, wherein the first control line and the second control line comprise an electric line, a hydraulic line, or a fiber optic line.

10. A lateral deflector comprising:

a lateral deflector body;

a lateral deflector top coupled to the lateral deflector body; and wherein the lateral deflector top is removable and configured to be decoupled from the lateral deflector body;

a deflection surface; wherein the deflection surface is a surface of the lateral deflector body and the lateral deflector top;

a feedthrough which is covered by the lateral deflector top when the lateral deflector top is coupled to the lateral deflector body; wherein the lateral deflector is positioned at a lateral borehole junction; wherein a control line is counted to the feedthrough and wherein the control line descends downhole of the lateral borehole junction.

11. The lateral deflector of claim 10, wherein the lateral deflector top is coupled to the lateral deflector body with a shear screw, snap ring, collet, or a combination thereof.

12. The lateral deflector of claim 10, further comprising a thru bore in the deflection surface.

13. The lateral deflector of claim 10, wherein the control line is coupled to an inflow control device, sensor, valve, artificial lift, interval control device, pump, or combinations thereof positioned downhole of the lateral borehole junction.

14. The lateral deflector of claim 10, wherein the feedthrough is adjacent to exterior sides of the lateral deflector body and said exterior sides form a dovetail-shaped cavity.

15. The lateral deflector of claim 10, wherein the feedthrough is adjacent to exterior sides of the lateral deflector body and said exterior sides form a circular-shaped cavity.

16. A method for connecting a control line to an intelligent tool positioned below a lateral borehole junction, the method comprising:

providing a lateral deflector comprising:

a lateral deflector body;

a lateral deflector top coupled to the lateral deflector body; and wherein the lateral deflector top is removable and configured to be decoupled from the lateral deflector body;

a deflection surface;

a feedthrough which is covered by the lateral deflector top when the lateral deflector top is coupled to the lateral deflector body; and wherein the feedthrough is coupled to a first control line which extends downhole of the lateral borehole junction and is coupled to an intelligent tool positioned downhole of the lateral borehole junction;

decoupling the lateral deflector top from the lateral deflector body;

removing the lateral deflector top from the lateral deflector body;

coupling a control line connector head to the feedthrough, wherein the control line connector head is coupled to a second control line which descends from the surface;

coupling the first and second control lines at the feedthrough to provide a connected control line; and using the control line to interact with the intelligent tool.

17. The method of claim 16, wherein the connected control line comprises an electric line, a hydraulic line, or a fiber optic line.

18. The method of claim 16, wherein the intelligent tool is an inflow control device, sensor, valve, artificial lift, interval control device, pump, or combination thereof.

* * * * *